United States Patent [19]

Gurak et al.

[11] 4,446,784

[45] May 8, 1984

[54] RESILIENT CHAIN STRAP WRAPPING AND TENSIONING DEVICE

[75] Inventors: Ronald W. Gurak, Fox River Grove; Eduardo P. Diploma, Carol Stream, both of Ill.

[73] Assignee: Signode Corporation, Glenview, Ill.

[21] Appl. No.: 384,220

[22] Filed: Jun. 2, 1982

[51] Int. Cl.[3] ..... B65B 13/10

[52] U.S. Cl. ..... 100/27; 474/231

[58] Field of Search ..... 100/27, 28; D8/499; 474/231; 198/838, 845

[56] References Cited

U.S. PATENT DOCUMENTS 3,045,584 7/1962 Willis et al. ..... 100/27

FOREIGN PATENT DOCUMENTS 1361794 4/1964 France ..... 100/27

*Primary Examiner*—Billy J. Wilhite

*Attorney, Agent, or Firm*—Dressler, Goldsmith, Shore, Sutker & Milnamow, Ltd.

[57] ABSTRACT

A chain strap wrapping and guide assembly including a plurality of crown-shaped rollers that are guided by V-shaped guides. The chain is driven by a motor operated sprocket.

5 Claims, 8 Drawing Figures

FIG. 1
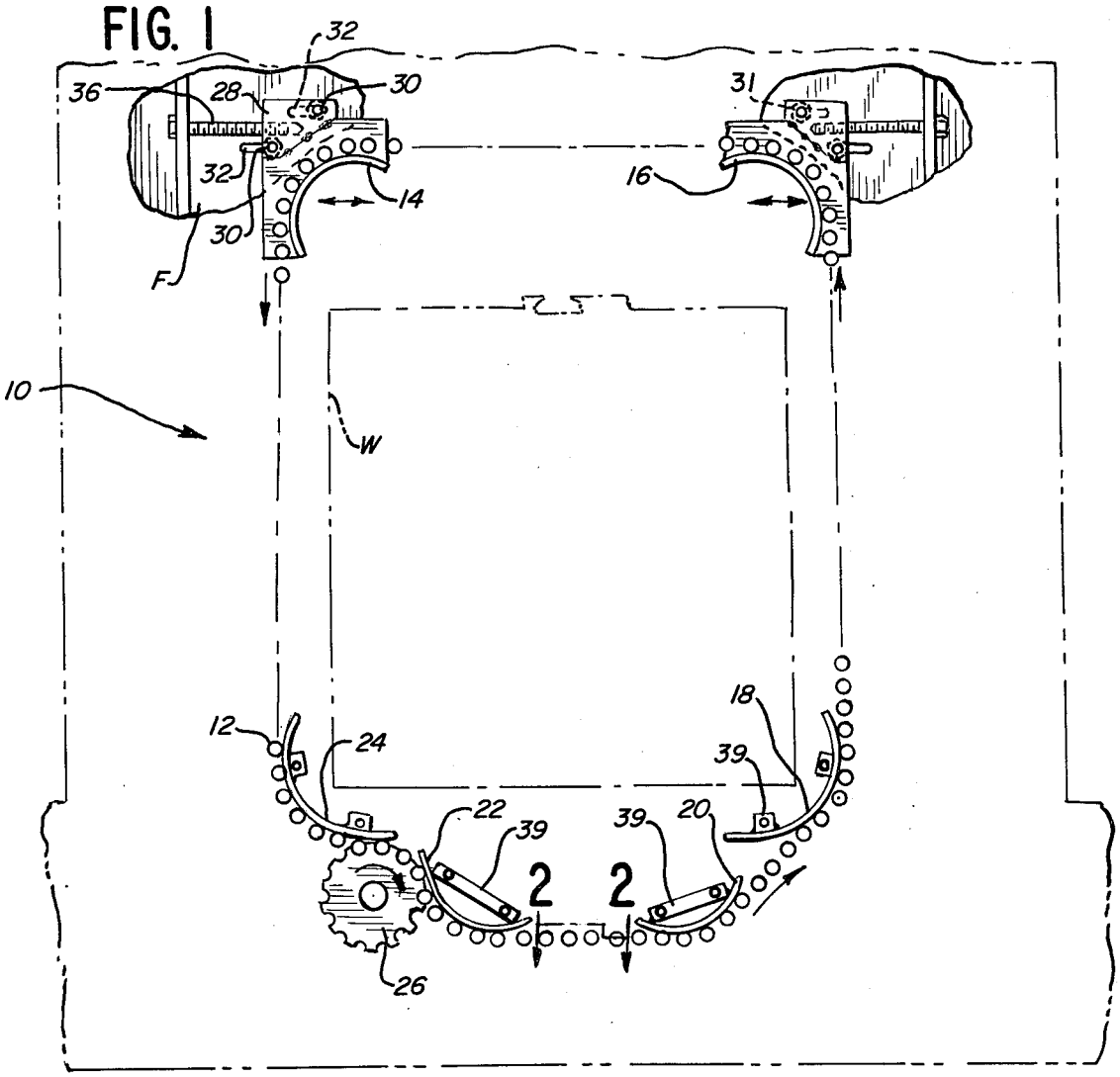
FIG. 2
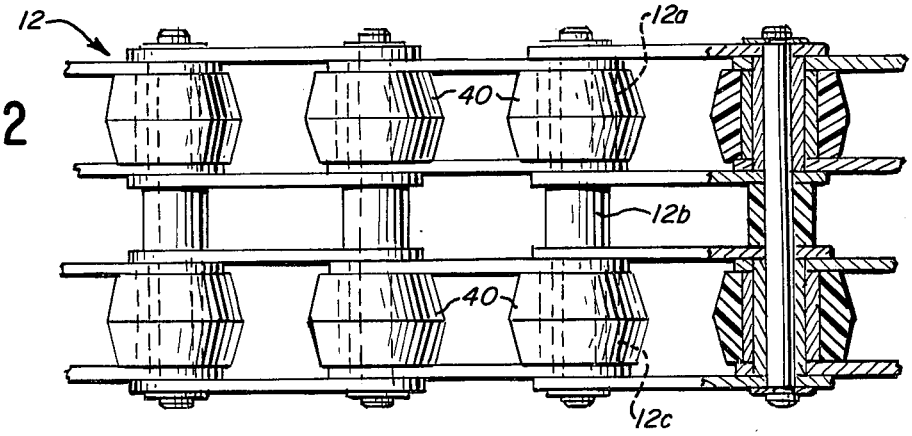
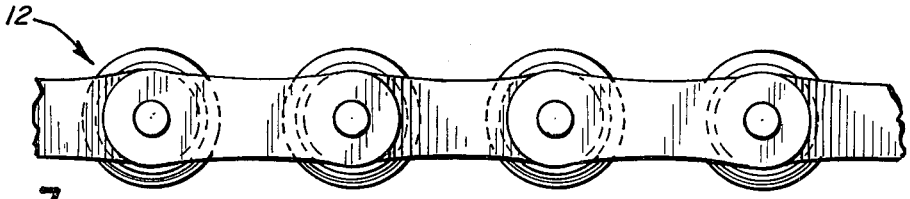
FIG. 3

FIG. 4
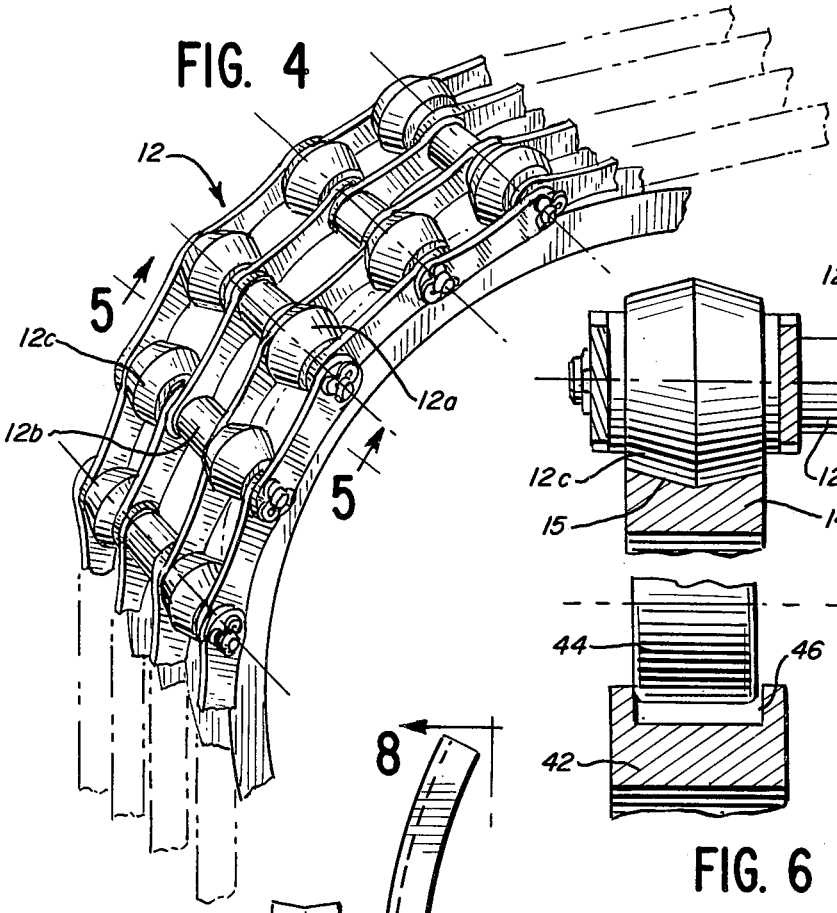
FIG. 5
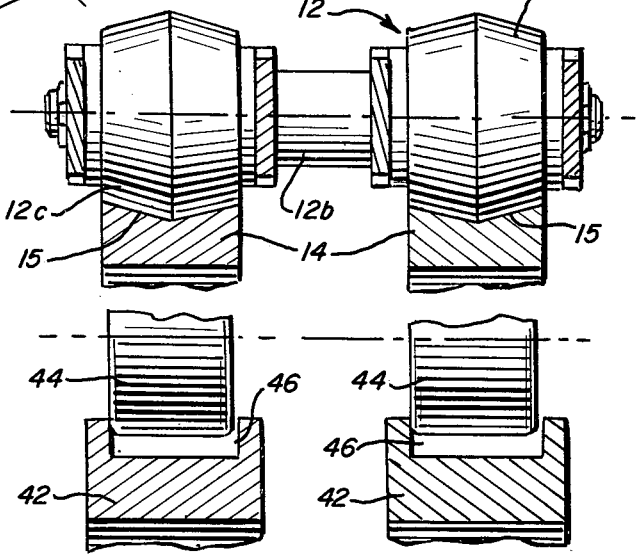
FIG. 6 PRIOR ART
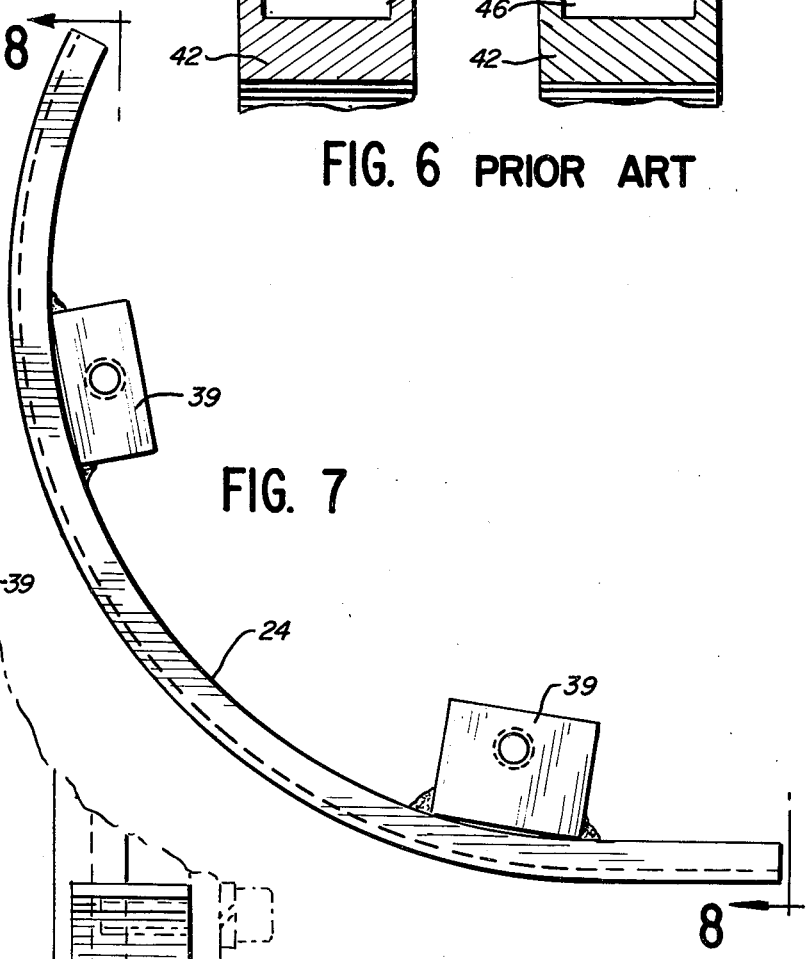
FIG. 7
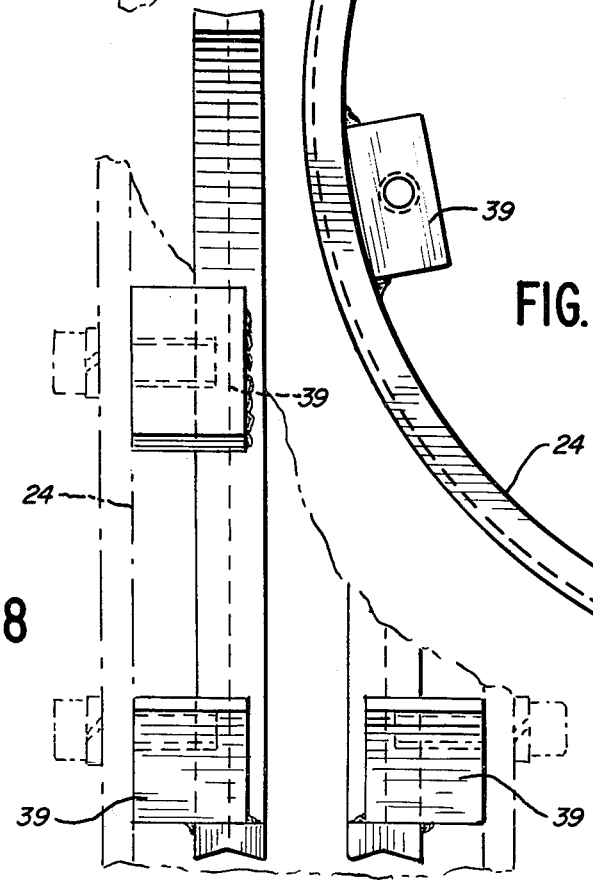
FIG. 8

RESILIENT CHAIN STRAP WRAPPING AND TENSIONING DEVICE

TECHNICAL FIELD

This invention relates to the field of wrapping assemblies for draping a strap about a package. It is directed to a chain strap wrapping and guiding device which insures that the chain is properly guided and maintained at all times.

BACKGROUND OF THE INVENTION

Heretofore, the conventional arrangement for wrapping a strap around a package employed a chain and sprocket arrangement consisting of four to eight pairs of sprockets for supporting the chain as the chain carries the strap around the package to be strapped. The chain generally consisted of three sections with the outer sections engaged by a pair of spaced sprockets and the inner section carrying a carrier for the strap being wrapped about a package. These sprockets take up considerable space and providing adjustment for the sprockets is a constant problem due to wear and other factors. Of greater concern is the ability to maintain the chain in proper alignment during the many cycles it is used and the high speed at which it is operated. It can be appreciated that if such automatic strapping machines can be provided with a chain drive that is quiet, long wearing, readily adjustable and is positively guided at all times that it would constitute a substantial advance in the art.

In accordance with the present invention, there is employed a system which involves but a single drive sprocket assembly to drive a resilient chain that carries strap about a package to be strapped. The chain during its travel about the package is supported by novel guide shoes which require less space than idlers and provides a unique configuration to insure centering of the chain at all times. In addition, the tension of the chain can be very readily adjusted. Heretofore, chains that have been used have had the tendency to ride out of their support brackets with the result that the chain can become disengaged requiring the machine to be shut down. The chain employed herein involves a unique V-shaped roller configuration which in combination with a plurality of V-shaped guide arrangements used for supporting the chain throughout its travel, insures that the chain will be properly positioned throughout its travel and guarantees long life. The simplicity of the guide design provides for quick and efficient adjustment of the tension of the chain.

These and other objects of the invention will be seen from the following drawings in which:

FIG. 1 is a front elevation view showing a chain uniquely guided about an article receiving station for wrapping a strap about a package;

FIG. 2 is a view taken of the chain taken along line 2—2 of FIG. 1;

FIG. 3 is a side elevation of the chain shown in FIG. 2;

FIG. 4 is a perspective view showing the chain moving around a guide;

FIG. 5 is a view taken along line 5—5 of FIG. 4;

FIG. 6 is a view illustrating the prior art;

FIG. 7 is a side elevation view of a guide embodying the present invention; and

FIG. 8 is a view taken along line 8—8 of FIG. 7.

Referring first to FIG. 1, there is shown an article receiving station 10 for receiving a package to be strapped. A chain 12 in shown disposed about the window W in which the package is to be located. The chain has three sections 12*a*, 12*b*, 12*c* *(see FIGS. 2 and 4). The two outer sections 12a,* 12*c* are to be supported by spaced guides and the inner section 12*b* includes a carrier (not shown) which carries the strap to be draped about the package. The guide system for the chain includes a pair of shoes 14, 16 at each upper corner and two pairs of shoes 18, 20 and 22, 24 at each of the lower corners. The shoes may vary in length and curvature as desired and are suitably secured to the frame in a manner to be described hereinafter. The chain 12 is driven by a drive sprocket assembly 26 shown in the lower left-hand corner of FIG. 1. In order to adjust the tension on the chain, the upper shoe assemblies 14, 16 can be moved in and out through the action of a threaded mounting block that is connected to each of the upper pairs of shoes. For example, the mounting block 28 for shoe assembly 14 is mounted to the frame 29 through bolts 30 that are disposed in slots 32 in the support frame 34. Adjustment of the threaded member 36 moves the mounting block 28 relative to the frame 34 which is permitted by movement of the bolts 30 in the slots 32. A lock nut 31 is provided on the bolts 30 to secure the shoes in position. The lower non-adjustable guides have support blocks 39 secured to their non-guiding sides through which fasteners are placed to secure them to the frame 34.

Referring to FIG. 2, there is shown the construction of the double chain arrangement which includes a plurality of bearing-mounted crowned urethane rollers 40 in sections 12*a* and 12*c* of the chain. As seen in FIG. 5, the novel guide shoes 14 for receiving the rollers 40 are constructed to define a V-shaped configuration 15 so that the rollers are positively located therein. With this novel roller-guide combination movement of the rollers will be down toward the center of the V which constantly insures centering of the chain during its travel. The other guide assemblies 14, 18, 20, 22 and 24 have a identical cross section.

In FIG. 6, there is shown a conventional construction wherein the chain guiding assembly 42 is generally channel-shaped and as shown therein, during any sidewise movement of the rollers 44 they would hit against the side of the guide support with the result that it may work its way up the wall of the guide and "walk" out of the grove 46. This could cause disengagement of the chain and require shutting down of the machine as well as possibly damaging other parts of the apparatus.

FIG. 7 is an enlarged partial view of shoe 24 and FIG. 8 is a view looking along line 8—8.

It is to be understood that while the novel chain and guide constructions has been illustrated for use with a strapping machine it is clearly not limited to such use. It can, of course, be used whenever conventional chains are employed.

It is, of course, to cover by the appended claims all such modifications and embodiments which come within the true spirit and scope of the invention.

What is claimed is:

1. A chain strap wrapping and guiding device comprising a chain mechanism including a plurality of crown-shaped rollers, a support structure, a plurality of V-shaped guides secured to said support structure for guiding said rollers and means for driving said chain mechanism.

2. A chain strap guiding device as set forth in claim 1 in which the rollers are constructed of urethane.

3. A guiding device as set forth in claim 2 in which a plurality of guides are provided and means are provided for adjusting the position of at least one of said guides whereby the chain can be maintained at the proper tension.

4. A chain guiding device as set forth in claim 3 in which the guides include mounting blocks secured to said support structure and the adjusting means for the adjustable guides includes an adjustable fastener means interconnecting the blocks to said support structure.

5. A chain guiding device as set forth in claim 4 in which the mounting blocks for the adjustable guides include a bolt which is movable in a slot defined by said support structure and the mounting block is locked in its adjusted position by a lock nut secured to said bolt.

* * * * *